United States Patent [19]

Dent

[11] 3,998,446

[45] Dec. 21, 1976

[54] METHOD OF MAKING BOOKLETS OF TOMBOLA OR BINGO TICKETS

[76] Inventor: Carl Richard Dent, 5 Quoite Meadow, Stonham Aspal, Stowmarket, Suffolk, England

[22] Filed: Sept. 22, 1975

[21] Appl. No.: 615,576

[52] U.S. Cl. ..... 270/18; 101/72

[51] Int. Cl.[2] ..... B41F 13/64

[58] Field of Search ..... 270/1, 21, 61, 10–17, 270/18, 52, 53; 101/72–79, 426; 273/135 B; 283/2–4; 40/107, 121

[56] References Cited

UNITED STATES PATENTS

| | | | |
|---|---|---|---|
| 614,809 | 11/1898 | Henkle | 270/18 |
| 3,421,752 | 1/1969 | Folino | 270/1 |
| 3,768,801 | 10/1973 | Maynard | 270/53 |
| 3,822,876 | 7/1974 | Frain | 270/1 |

*Primary Examiner*—Clifford D. Crowder
*Assistant Examiner*—A. Heinz
*Attorney, Agent, or Firm*—Strauch, Nolan, Neale, Nies & Kurz

[57] ABSTRACT

A method of producing booklets of tickets for playing the numbers game known, for example, as bingo involves belt printing a series of differently colored webs. Serially arranged on the belt is a multiplicity of different printing plates, each of which is to print a plurality of tickets, each ticket having a combination of numbers dissimilar to the combination of any other ticket to be printed using the belt. The webs are identically printed simultaneously during a rotation of the belt, and as they issue from their respective printing stations, the webs are effectively shifted longitudinally and are superposed such that (1) the impressions of the printing plates thereon are in substantially exact, superposed registry and (2) nowhere in the superposed webs is there a collation of superposed registered impressions containing two or more impressions of the same printing plate. Having so superposed the webs, they are then subjected to appropriate slitting and uniting operations to convert them into booklets of tickets.

17 Claims, 7 Drawing Figures

METHOD OF MAKING BOOKLETS OF TOMBOLA OR BINGO TICKETS

The invention is concerned with printing booklets of tombola or bingo tickets. The term "tombola", strictly speaking, refers to the numbers game played in the U.K. and generally known as BINGO. The term "bingo", strickly speaking, refers to the basically similar numbers game played in the U.S.A. In this specification, these two terms are used in their correct senses unless specifically indicated to the contrary.

As is well known, a tombola ticket usually presents a printed grid having nine vertical columns of rectangular boxes arranged in three horizontal rows. Certain of the boxes are numbered with different numbers printed on the ticket and the remainder are left blank. Presupposedly, all the tombola players who purchase tickets have a different combination of an equal number of numbers on each ticket so as to have, with each ticket, an equal chance of winning the game.

In one particular exemplary set or sequence of tombola tickets at present supplied to the Trade there are 12,000 different combinations of 15 different numbers selected from the numbers 1 to 90 inclusive. The 12,000 different combinations are printed on up to 10 different colours of colour coded paper so as to give a sequence of tombola tickets consisting of a maximum of 120,000 tickets not one of which has both the same combination of numbers and the same colour as any other ticket in the sequence. The tickets supplied to the trade are presented in booklet form, as "units". A unit is a set or edition of tickets which contains a maximum of 120,000 different tickets. a booklet of tickets may comprise 10 tickets each printed on a paper of a different code colour. 12,000 such booklets make up the said set of tickets, and the booklets are serially numbered from 1 to 12,000 inclusive. The purchaser of such a 10-ticket booklet can participate in a sequence of 10 games. It is commonplace for the booklets to be supplied to the Trade in strips of six booklets arranged one below another and joined along lines of perforations which enable the booklets to be separated from one another by tearing. Corresponding tickets in the six booklets are printed on paper of the same code colour, and the six tickets of any particular colour code have, between them, all the numbers 1 to 90 appearing. In this way any number called can be found by a player buying a "strip of booklets" i.e. a group of six booklets, on the six tickets of any particular colour code in the strip. There are five numbers in each horizontal row on each ticket and one, two or three numbers in each vertical column on each ticket. Numbers from 1 to 9 inclusive appear in the first or left hand column, numbers from 10 to 19 inclusive appear in the second column and so on up to the last or right hand column in which appear the numbers from 80 to 90.

At the present time, supposing one is producing a set of tombola tickets composed of 120,000 different tickets wherein 12,000 different number combinations are printed on 10 different codes of paper, the 12,000 tickets of each colour code are printed separately and so are covers with which the booklets of tickets are provided. The differently coded tickets are then collated into booklet batches of 10 tickets, one of each code, and with numbered covers. The booklets of 10 tickets and their covers are then collated into sets of 12,000 booklets, the sets each including 120,000 different tickets.

The printing is carried out so as to produce the booklets in a multiple of groups of six, i.e. in "strips" as above described with the correspondingly coded tickets showing all the numbers 1 to 90; and the production includes the steps of stitching the booklets and perforating the joins between the adjacent booklets of the "strips" and between the adjacent "strips" themselves. Careful checking of the collations and of the final sets of 12,000 booklets is necessary since the final sets are selected from a stock of identically printed sheets printed in a given run, and more than one set of 12,000 booklets is made up at one the same time from this stock.

This procedure is time consuming and requires a large number of people to operate it with a consequent need for a considerable amount of space.

Of course, it is not essential for the booklet always to contain 10 differently-coded tickets: a greater or lesser number is sometimes used, thus increasing or decreasing the total number of tickets in a corresponding full set of booklets. Thus, for playing a three game series, for instance, three-ticket booklets are needed. A full set of three-ticket booklets supplied to the trade will then contain three times 12,000, or 36,000, different tickets.

It has also been proposed to print tickets on both sides. This not only saves paper but reduces the number of colours without reducing the total number of combinations because the tickets may readily be printed in such a way that it is always evident whether a particular combination of numbers (e.g. 15 numbers) on the ticket appears on the front or the back of the ticket.

The present invention broadly provides a method of producing a set of tombola or bingo ticket booklets each comprising differently coded tickets coded by colour, background pattern, or by code means other than the combinations of numbers printed on the tickets, the booklets in the set having coded tickets arranged in a predetermined order or code sequence common to all the booklets, and the method including the steps of (a) identically printing the different number combinations to appear in the set of booklets on one or both sides of each of a plurality of webs, the number of webs being determined by the number of tickets to be in each booklet so that each web as printed is identical to the other webs except for the code of tickets appearing on that web, (b) superposing the webs in the said predetermined order required of the tickets in the booklets upon a further web on which booklet covers have been printed, the identically-printed webs being superposed one upon another with their printed number combinations in step-shifted registration, (c) thereafter uniting the superposed webs and severing therefrom the required set of booklets, the step-shifted registration effected before uniting and then severing the webs being such that the number combinations borne by the tickets in each booklet differ from one another.

The cover of each booklet may be printed on the cover web or webs with a unique number within a predetermined range of numbers i.e. 1 to 12,000 for a set of the booklets making up a complete sequence of tickets. Such a booklet set constitutes the aforementioned unit supplied to the trade.

The tickets are conveniently printed on the webs or web series so that the resulting booklets formed from the stepped superposed webs are organised in "strips" one below the other to form a "strip of booklets" and the corresponding tickets of the booklets of each "strip" have, between them, all the numbers 1 to 90 appearing.

Conveniently, also, the printed superposed webs are united by gluing to form the booklets along what may be regarded as the spine sides of the booklets.

The superposed webs in the strips of booklets, are perforated to render separation into individual booklets by tearing along lines of perforations.

A sequence of tickets bearing all the possible combinations of numbers can be produced by a method according to this invention wherein a single web is printed in a single continuous printing operation using a belt printing press to print the web in one pass or rotation of the belt. It might be preferred however to print a web in this fashion and thereafter cut the web lengthwise to form from it a series of printed webs which have to follow end-to-end, to form the said single web. Of course, such a series of webs might be printed separately but it is preferable to print the complete sequence of combinations in a single continuous printing operation, since then only a single belt has to be used on the belt press and the belt or plates on the belt do not have to be changed.

The term "belt" as used herein is to be understood to embrace: a support web incorporating printing plates either detachably mounted thereon or integrally formed therewith: and a pair of drive cables or chains bridged at intervals along their lengths by printing plates.

A specific embodiment of the present invention will now be described, by way of example, with reference to the accompanying drawings in which.

Figure 4:
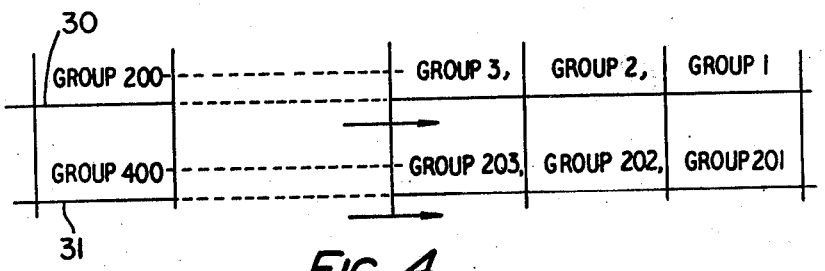
Figure 5:
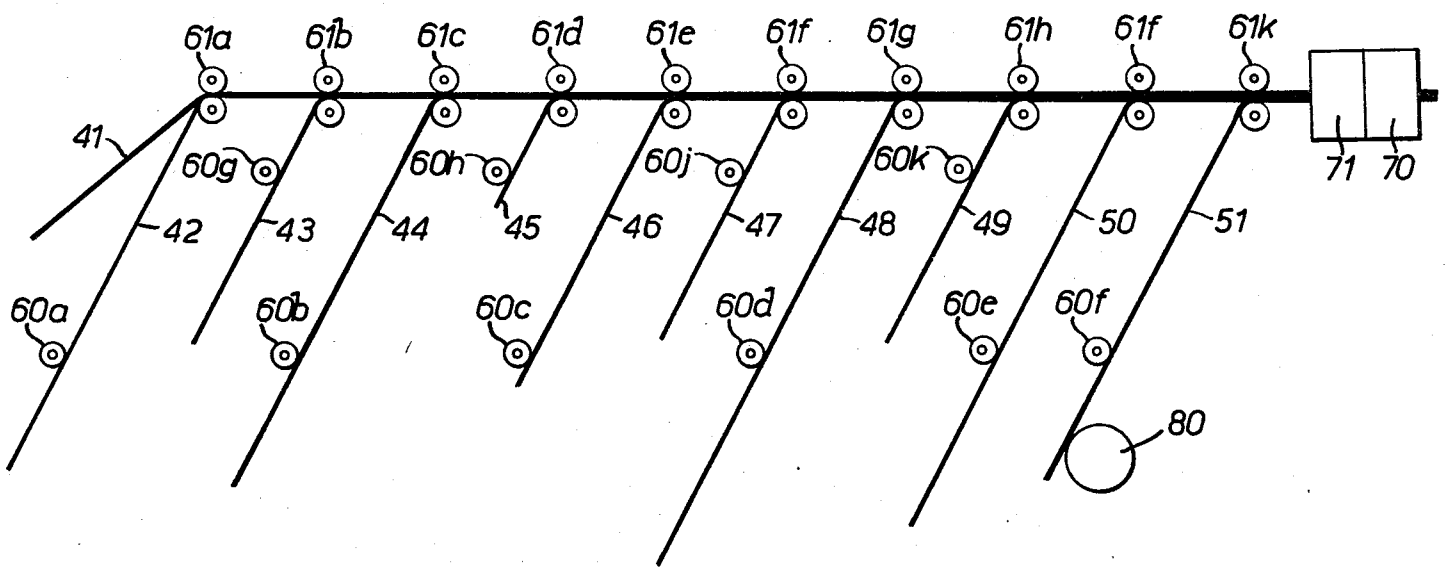
Figure 6:
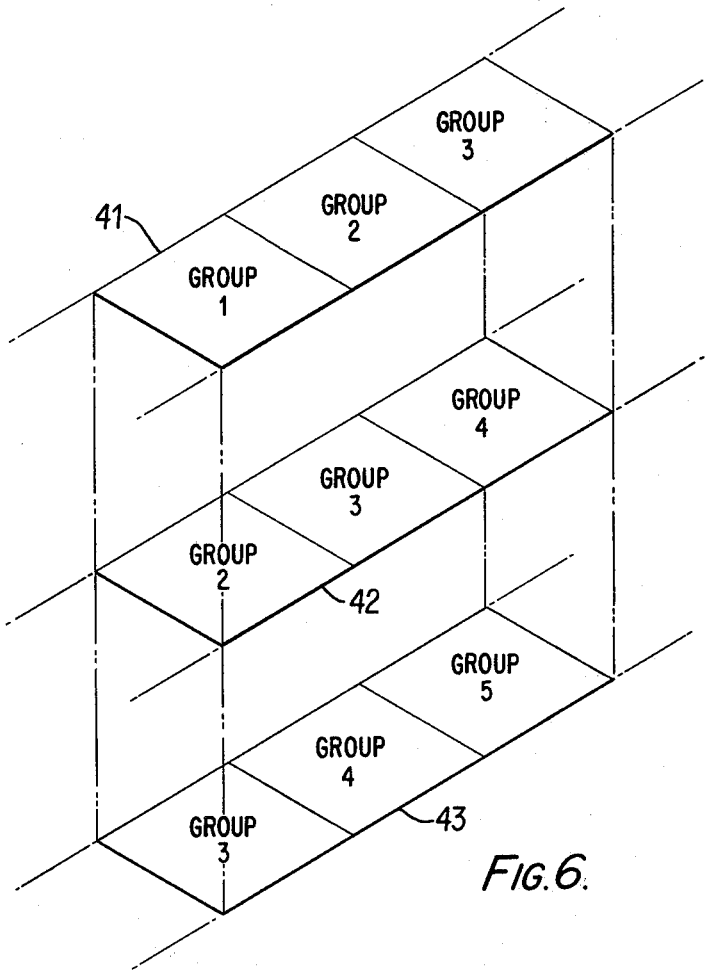
Figure 7:
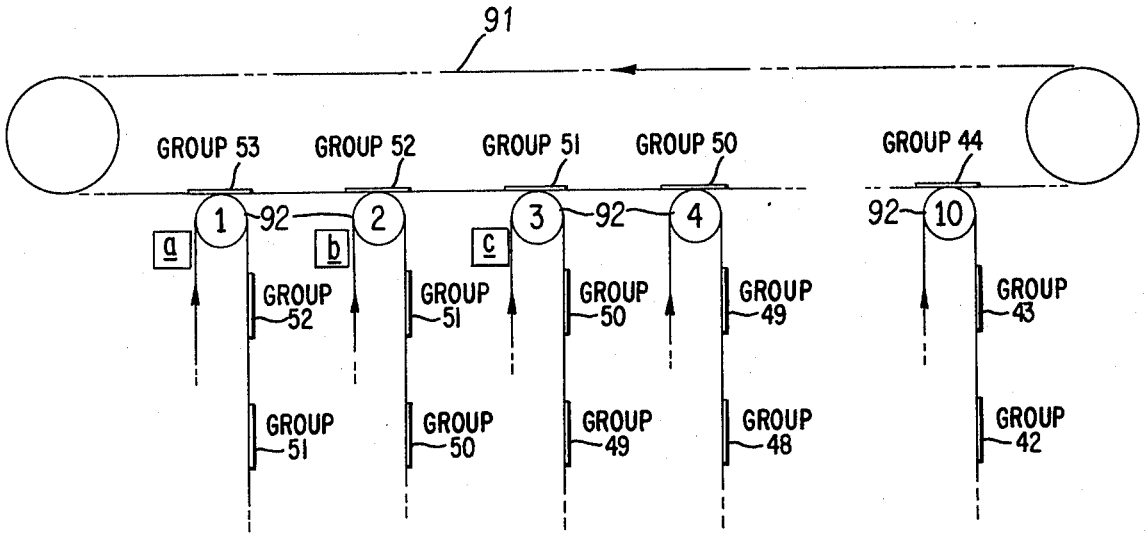

FIG. 4 diagrammatically illustrates the manner of printing applied to a web of paper; and FIG. 5 is a further diagram illustrating a collating and assembling operation;

FIG. 6 is a diagram in perspective illustrating step-shifted registration of superposed, identically-printed webs; and FIG. 7 is a diagram illustrating a printing scheme for a number of webs.

Figure 1:
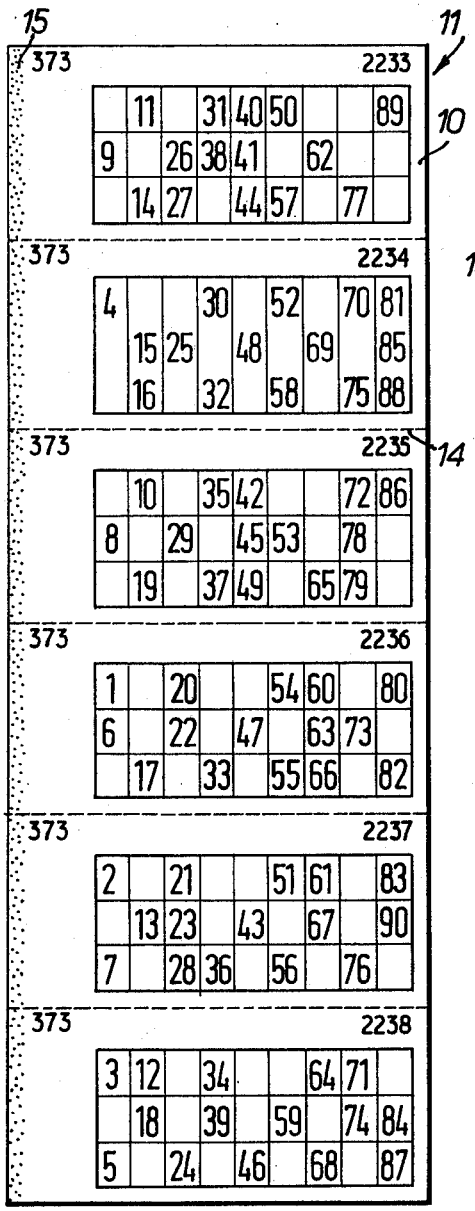
FIG. 1 is a front view of a "strip" of tombola tickets as hereinbefore described.
Figure 2:
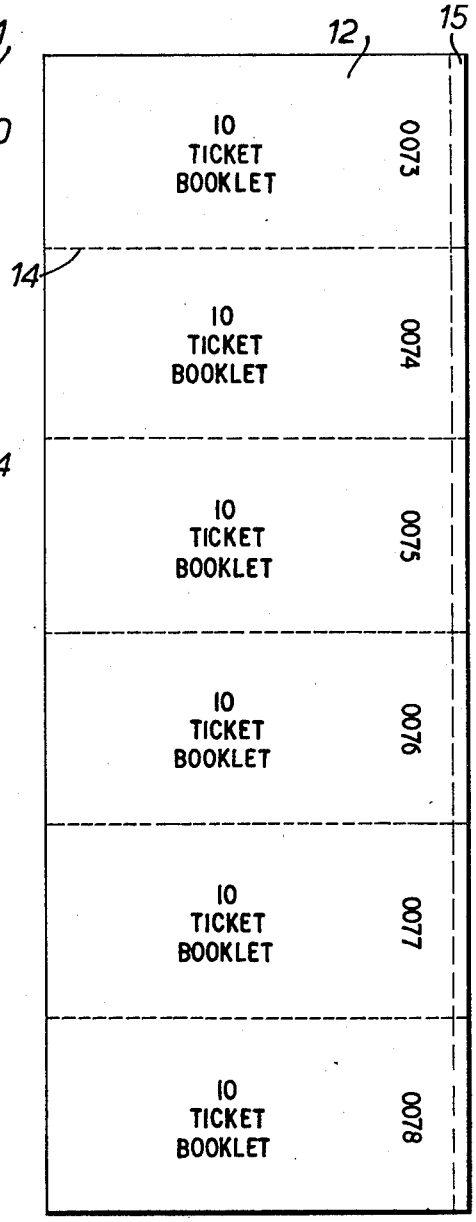
FIG. 2 is a rear view of the "strip" of tickets shown in FIG. 1.

Referring to FIGS. 1 and 2 the method which is about to be described is for the production of the particular sequence of tombola tickets, the tickets 10 being printed on one side on different papers, coded for instance by colour, so as to give multiples of 6,000, 15-number combinations per paper. By using10 differently coloured papers, for example, the 6,000 combinations yield a sequence of tickets containing 60,000 different tickets. 6,000 different number combinations can be conveniently printed using a 200 ft. printing belt. Where a ticket sequence of 120,000 different tickets are required to be provided on 10 differently coloured papers, a 200 foot printing belt can still be used, but the plates thereon need to be replaced by different plates half way through. That is, the belt would be used to print a first sequence of 6,000 different number combinations and, after plate-changing, a second sequence of 6,000 different number combinations. Alternatively, plate-changing half way through could be avoided by utilising a belt twice as long (i.e. 400 feet) having twice the plate capacity.

FIGS. 1 and 2 show front and rear views of a booklet "strip" which is made up of six booklets 11 joined together. The booklets 11 are consecutively numbered on their back covers 12, as shown in FIG. 2. Each booklet contains 10 tickets 10 printed on 10 differently colour-coded papers, and in the six-booklet strip, the six tickets of any one colour code appear on a single ticket page of the "strip". The six tickets of one colour code appearing on the front ticket page of the "strip" are on view in FIG. 1, and, as may be seen, the arrangement of the numbers, columns and rows is in accordance with the particular sequence of tombola tickets hereinbefore described. All the numbers between 1 and 90 are to be found, therefore, on the illustrated front ticket page.

The individual booklets are joined along lines of perforations 14, so as to be separable from one another by tearing, and the tickets of each booklet are united along a glue seam 15 at the left hand side in FIG. 1; the said left hand side of each booklet 11 may be regarded as the spine of the booklet.

Figure 3:
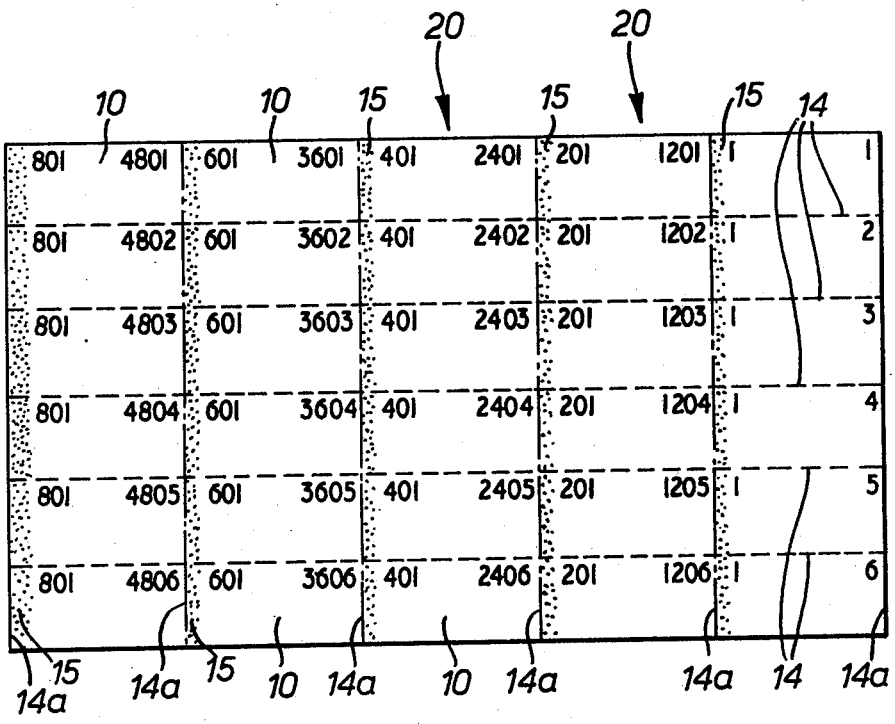
FIG. 3 illustrates a format of printed tickets.

A printing belt for the 6 or 12,000 different number combination tickets is produced, having plates to print groups of 30 tickets 10 arranged as shown in FIG. 3. The illustrated group of tickets is approximately 12 inches by 20 inches in overall dimensions. One way of printing 12,000 different number combinations can, for example, involve printing arrangements for 200 of these groups of tickets 10, 100 along each side of the belt. This can be accomplished using a 200 ft. printing belt approximately 40 ins. wide. The first 6,000 number combinations of the 12,000 different number combinations are positioned on say the left hand side of the belt and the remaining 6,000 number combinations are positioned on the right hand side of the belt.

The group of tickets shown in FIG. 3 comprises five vertical columns each, containing six tickets 10 so as to form a total of five "strip" ticket pages 20. Each ticket page 20 has a page number thereon. In FIGS. 1 and 3, the page number is printed in the top left hand corner of each individual ticket for checking purposes. For a similar purpose the different number combination tickets are individually numbered from 1 to 12,000 and conventionally these ticket numbers run consecutively from top to bottom down each "strip" ticket page 20. The ticket numbers are located at the top right hand corners of the individual tickets.

Where, as in the U.K. games are played involving 15 number combinations of the numbers from 1 to 90, that is games of "tombola" as the term is used herein, the different number combination tickets produced must be a multiple of six to produce strips of booklets containing six booklets, as herein described. If games involving 25 number combinations of the numbers 1 to 75 are played, as in the U.S.A. under the correct name "Bingo", then the different number combination tickets must be a multiple of three in this case to produce booklet strips containing three booklets.

Visible in FIG. 3 are horizontal dashed lines 14 and vertical lines **14*a*: these represent lines of perforations and slit lines respectively. The perforations and slits are made subsequently and will be described hereinafter. Also shown are vertical shaded bands which represent glue lines 15** provided by gluing wheels to enable the pages of the end product to be stuck to one another.

It is a relatively straightforward matter to print and produce sets of so-called "bingo-books" simultaneously alongside the tombola tickets and booklets. As known in the U.K., bingo books consist of a plurality of bound pages, each comprising a strip of six tear-off Tombola tickets. The pages of any one set of bingo books are all of the same colour. Bingo books having a full complement of pages may contain all the 12,000 different number combinations which appear in the corresponding set of Tombola ticket booklets. The six ticket pages each have a stub end enabling them to be sewn, stapled or glued together during binding.

In order to best understand the way in which it is envisaged to produce both tombola ticket booklets and bingo books, the printing scheme will briefly be described. Associated with the printing belt are 10 different stations to which 10 differently coloured webs of paper can be fed. As the belt is moving, each one of the plates thereon passes from station to station and at each station the corresponding web is printed accordingly. This readily achieved automatic step-shifting of images is best illustrated in FIG. 7. Ten printing stations 92 are positioned beneath printing belt 91. For purposes of illustration, plates for groups 44. . .50, 51, 52, 53 are shown at stations 10. . .4, 3, 2, 1. Thus, the webs are being simultaneously printed at 10 serially arranged stations in step-shifted fashion so that at any aligned portions of the webs, different groups are in registry, as is also shown in FIG. 7 on those portions of the webs to the right hand side of each web which have been printed. Following a complete pass of the belt, all the webs will be printed indentically with a plurality of groups as illustrated in FIG. 3. By adding a further station, (not shown) a further web could be printed in the same manner. From this further web the set of bingo books are made.

However, it is not essential to provide a further station, because on occasions some of the 10 stations are not in use for printing tombola ticket booklets. This is because there may be a call to produce ticket booklets having less than 10 ticket pages. Suppose it is required to produce ticket booklets containing only eight ticket pages — for an eight game series. Then two of the stations are "free". If these stations are fed with appropriate webs and these webs are printed, then these two webs can be utilised to make two sets of bingo books.

For producing tombola booklets and related bingo books, it is convenient to supply the trade with multiples of 6,000 different number combinations, for instance the 12,000 to which the specific example herein is directed. A set of bingo books whose ticket pages each contain six individual tickets will therefore have 12,000 divided by six, or 2,000, pages. A 2,000 page book would be extremely bulky and difficult to bind. Instead, the 2,000 pages are divided into a plurality of volumes. For example, each volume can contain 250 tickets pages. A complete set of bingo books will then comprise eight volumes.

The term "bingo" used in "bingo books" is not used in the strict sense referred to at the beginning of this specification, since the tickets in these books are for playing the game correctly known as tombola. The tickets thus contain combinations of 15 numbers selected from numbers 1 to 90 inclusive.

It will be recognised that the preparation of the tombola ticket booklets involves printing the covers 12 for the individual booklets. Groups of individual covers 12 can be printed on a separate cover web, and the cover groups can each be arranged in a manner akin to that shown in FIG. 3 for a group of tickets. The necessary printing of the cover web can be accomplished with a separate belt or belt press with an in-line numbering print unit. This unit provides the booklet numbers which are seen along the right-hand edge of the illustration seen in FIG. 2.

The concept of printing groups of tickets containing 6,000 number combinations in two rows on a 40 inch wide belt has been described earlier. The left hand row contains the first 6,000 number combinations and the right hand row contains the remaining 6,000 number combinations.

The same concept can be applied to the printing of the cover web. A printed cover web ready for uniting with the colour coded webs will then have 200 succeeding groups of covers extending along the left hand side of the cover web. Another 200 groups will extend along the right hand side of the cover web. Considering the succeeding groups along the left hand side of the cover web; these will exhibit five, side-by-side rows of covers — see FIG. 3 for comparison. The numbering print unit operates to number the individual covers sequentially as follows:

| (left hand) Row 1 | Row 2 | Row 3 | Row 4 | Row 5 |
|---|---|---|---|---|
| 4801 to 6000 | 3601 to 4800 | 2401 to 3600 | 1201 to 2400 | 1 to 1200 |

The covers printed on the right hand side of the cover web will be sequentially numbered in a similar way such that these covers are numbered from 6001 to 12,000.

Referring now to FIG. 4, there is diagrammatically indicated the way a web may be printed for producing the tickets. The two horizontal lines 30, 31 represent a single web of paper which is subsequently slit longitudinally into two separate half-width webs. The web 30 from the left hand side of the machine is printed with groups of tickets, see FIG. 3, in the following manner: Group 1, Group 2, Group 3 . . . and so on to Group 200, while the web 31 from the right hand side of the machine is printed in this sequence: Group 201, Group 202 . . . and so on to Group 400. The webs 30, 31 can be joined endwise to form a narrow, single web so that when run end-to-end, Groups 1 to 400 appear in numerical sequence. The numbers just assigned to the Groups are provided for ease of understanding only.

Ten webs of paper of the 10 different colour codes are printed in the same way and the webs slit longitudinally in two.

As aforesaid the printing operation can be conducted in such a way that the moving belt prints a first web, then a second web, and so on through the series of webs in turn.

The ten ticket webs and the single cover web are then collated and assembled. Thus referring to FIG. 5 the webs indicated by the reference numerals 41 to 51 are so fed that the webs are superposed one upon another, web 41 being on top of the web 42 and so on going from left to right in FIG. 5 with web 51 at the bottom. The latter web is the web from which the booklet covers 12 are ultimately obtained.

The webs are registered in superposed off-set relationship, whereby the groups printed on web 41 overlie the groups printed on web 42, which in turn overlie the groups printed on web 43, and so on. The off-set relationship is such that the groups are disposed with respect to one another as follows:

| | | | | | |
|---|---|---|---|---|---|
| Web 41 | Group 1 | Group 2 | Group 3 | ... | and so on |
| Web 42 | Group 2 | Group 3 | Group 4 | ... | and so on |
| Web 43 | Group 3 | Group 4 | Group 5 | ... | and so on |
| Web 44 | Group 4 | Group 5 | Group 6 | ... | and so on |
| Web 45 | Group 5 | Group 6 | Group 7 | ... | and so on |
| Web 46 | Group 6 | Group 7 | Group 8 | ... | and so on |
| Web 47 | Group 7 | Group 8 | Group 9 | ... | and so on |
| Web 48 | Group 8 | Group 9 | Group 10 | ... | and so on |
| Web 49 | Group 9 | Group 10 | Group 11 | ... | and so on |
| Web 50 | Group 10 | Group 11 | Group 12 | ... | and so on |

The arrangement is illustrated in FIG. 6 wherein but three webs and three groups in each web are illustrated for purposes of clarity. The portion of the tabulation above that is illustrated as:

| | | | |
|---|---|---|---|
| Web 41 | Group 1 | Group 2 | Group 3 |
| Web 42 | Group 2 | Group 3 | Group 4 |
| Web 43 | Group 3 | Group 4 | Group 5 |

This offset superposition relationship ensures Group 10 printed on web 50, for instance, is never overlaid by the same Group printed on any of the other webs 41 to 49. This relationship is equivalent to that achieved by arranging the webs so that the 10 Group 10's are stacked one on top of another, then shifting webs 41 to 49 longitudinally one step, that is by 12 inches, to stack nine Group 9's on the Group 10 of web 50, then shifting webs 41 to 48 longitudinally again one step to stack eight Group 8's on the Group 9 and Group 10 of webs 49 and 50 respectively. This step-shifting process is repeated until Groups 1 . . . 10 of webs 41 . . . 50 are stacked one on top of another, Groups 2 . . . 11 of webs 41 . . . 50 likewise and so on as suggested by the above tabulation. The step-shifted registration of the Groups just elaborated ensures that in a complete set of 12,000 booklets, any particular 15 number combination of a particular colour code appears once only. It will be appreciated that the step-shifted registration is such that the number combinations borne by the tickets in each booklet differ from one another.

The superposed printed webs are glued and slit or cut so that from each stack of ten Groups are formed 10 strips of booklets, perforated ready for separation into 10 six booklet strips and stacking in proper numerical order. Thus, the collating and assembling apparatus includes gluing wheels 60*a* to 60*k* for applying lines 15 of hot melt glue to all the webs except web 41, the glue lines extending longitudinally of each web at the relevant positions across the web. The webs are fed through one or more of the sets of pinch rollers 61*b* to 61*k* inclusive to unite the webs at the glue lines. Apparatus 71 is provided for perforating the superposed webs along the join lines of the individual booklets, that is for perforating lines along the horizontal dashed lines 14 of FIG. 3, and for slitting along the vertical join lines 14*a* between adjacent six-booklet "strips", apparatus 70 is provided. Thus, apparatus 70, which succeeds apparatus 71, serves to sever the united webs into six booklet strips along the vertical lines 14*a*.

In the above described method, each web is printed with a plurality of sequentially arranged groups, each of which is arranged in the manner suggested by FIG. 3. Thus, each group comprises a plurality of individual tickets printed in rows across the web and columns along the web. The printed tickets are disposed with their longer dimensions extending laterally with respect to the web. As particularly described with reference to FIG. 4, the sequentially arranged groups extend along the single web in two side-by-side bands, respectively containing groups 1 to 200 and 201 to 400. The web is subsequently severed in half lengthwise into a pair of webs that are subsequently arranged end-to-end enabling the groups 1 to 400 to be presented in turn for superposition in appropriate step-shifted registry with groups of the other coded webs, as explained in detail hereinbefore. Each group is so printed that the printed tickets thereof are separable into "strips" of several tickets. Each strip has all the numbers 1 to 90 appearing.

The apparatus may further include means for marking the overlap delivery on the cover sheets in 25's or 50's.

The apparatus in FIG. 5 may further include a cover numbering unit and moreover an overprinting unit 80 for overprinting the covers printed on web 51 to take account of different language requirements, when producing tombola booklets for foreign markets.

Upon delivery there now remains the sequential wrapping and packing in such forms as required, and this is readily achieved by currently adopted procedures or in any other convenient way.

Instead of using paper of 10 different coded colours to form the webs 41 to 50, white paper webs could be used overprinted to tint or mark each web with a different colour or pattern or combination of colour and pattern so as to code all the webs and render them readily distinguishable from one another.

Any known or convenient means may be employed to maintain the superposed webs in correct stepped register during the collating and assembling steps.

The advantages of the method of producing sets of tombola tickets which has been described are that there is no need to store printed gathers of sheets or webs for subsequent use. Instead, production and delivery of individual tombola sets can be effected in turn and at short notice. Storage space is therefore eliminated together with a large labour force.

I have described a method which presently is the most convenient, and which involves severing the as-printed webs in half lengthwise. Conceivably, the need to sever could be eliminated if the printing belt were made twice as long so as to contain 400 plates arranged in line, one following another.

For security reasons, some markets demand that every ticket shall have an identifying number printed on its obverse. Australia is one such market. The requirement is for all tickets of a given code in a "unit" (or edition of tickets which are supplied to the trade as mentioned at the beginning of the specification) to have the same number. This number must be different from (1) the identifying number applied to the tickets of a different code in the same "unit", and (2) the identifying number applied to the tickets of the same given code in any other "unit". As an example, during a Tombola session, a game may be in progress employing blue-coded tickets of identifying number X. The person claiming to have won the blue game must produce his winning ticket and this must bear identifying number X. The identifying number will help defeat the cheat who may produce a blue ticket having the same number combination but which has identifying number Y corresponding to a ticket issued for a game held sometime in the past.

The present method extends to the printing of identifying numbers on the obverse of the tickets printed.

This could conceivably be accomplished by taking each printed web received from the belt printer and feeding it into another printing press. Such a procedure would be very cumbersome, however, and in practice would complicate subsequent collation and checking. Doubtless costly errors would from time to time arise.

The preferred procedure is to place adjacent the belt a numbering unit for each different web to be printed by the belt, and to advance each numbering unit appropriately once for every complete rotation of the belt.

Suppose a belt printing press is used which can, in one revolution, print 400 Groups of 30 different tickets, and the intention is to make a multiplicity of three-ticket booklets — i.e. for three-game series. For this purpose, blue, green and yellow webs are to be printed by the belt at stations A, B and C. Adjacent each of these stations there is an obverse-numbering unit *a*, *b*, *c* as illustrated by way of example, in FIG. 7 at the stations 1, 2 and 3. Of course, stations 4 through 10 would be open stations in this one example. The first revolution of the belt will print Edition (Unit) I, and the blue web of that Edition will be numbered 1 by numbering unit *a* on its obverse, in registry with each of the 400 × 30 tickets printed thereon. Meanwhile, the green and yellow webs are similarly printed by units *b* and *c* with numbers 2 and 3 respectively.

As the belt begins its second revolution, during which Edition (Unit) II is printed, numbering units *a*, *b* and *c* are tripped to advance them each by three. The obverse of each ticket on the blue web will now be printed by *a* with number 4, the green web by *b* with number 5 and the yellow web by *c* with number 6. Then, the numbering units are again tripped to advance them by three as the belt starts its next revolution. This procedure is repeated until the printing for all the required Editions or Units has been accomplished.

It will be recognised that all the obverse-numbering units are advanced a constant amount each belt revolution, the amount equalling the number of ticket pages that are to be in each booklet. When producing 10-ticket booklets, therefore, the obverse-numbering units advance as follows:

| | unit a prints | unit b prints | unit c prints |
|---|---|---|---|
| 1st Revolution | 1 | 2 | 3 |
| 2nd Revolution | 11 | 12 | 13 |
| 3rd Revolution | 21 | 22 | 23 |
| 4th Revolution | 31 .... | | |
| .... and so on. | | | |

I claim:

1. A method of producing a set of tombola/bingo tickets booklets each comprising diffently coded tickets coded by code means other than different combinations of game numbers printed on the tickets, to render each ticket readily distinguishable from the other tickets in the booklet, the booklets in the set having the coded tickets arranged in a predetermined code sequence order common to all the booklets and the method including the steps of (a) identically printing the different game number combinations to appear in the set of booklets on at least one side of each of a number of webs, the number of webs being determined by the number of tickets to be in each booklet, so that the printed webs are identical to one another save for said readily distinguishable rendering thereof, (b) superposing the webs in the said predetermined code sequence order required of the tickets in the booklets upon a further web on which booklet covers have been printed, the identically-printed webs being superposed one upon another, lengthwise with their printed game number combinations in step-shifted registration, whereby any given printed game number combination on any one of the webs is offset longitudinally, with respect to the length of the webs, from the same printed game number combination on all the other webs, and (c) thereafter uniting the superposed webs and severing therefrom the required set of booklets, the step-shifted registration effected before uniting and then severing the webs resulting in the game number combinations borne by the tickets in each booklet differing from one another.

2. A method as claimed in claim 1, wherein cover printing of the further web is conducted simultaneously with the printing of all the identically printed ticket webs.

3. A method as claimed in claim 1, wherein the cover printed for each booklet is printed on the further web with a unique number within a predetermined range of numbers for a set of booklets making up a complete set of the tickets.

4. A method as claimed in claim 1, wherein the united webs are severed into strips each comprising a plurality of booklets detachably joined one below the other to form a strip of booklets, and the tickets of any given code of the booklets forming each strip have between them, for Tombola, all the numbers 1 to 90 appearing, and for Bingo all the numbers 1 to 75 appearing.

5. A method as claimed in claim 4, wherein the superposed webs are perforated subsequent to the printing operation to facilitate detachment of individual booklets, from each strip of booklets, by tearing along lines of perforations.

6. A method as claimed in claim 1, wherein the identically printed webs and the further web are united by gluing.

7. A method as claimed in claim 1, wherein all the different game number combinations to appear as tickets in the set of booklets are printed on each web in a single continuous printing operation using a belt printing press during one pass of the belt.

8. A method as claimed in claim 7, wherein the tickets printed on each web are disposed in longitudinally extending bands thereon, the web being thereafter cut longitudinally into a series of narrower webs each containing a single band, and the series of narrower webs being arranged to follow one another end-to-end.

9. A method as claimed in claim 7, wherein the tickets are printed on each web in a plurality of groups arranged sequentially upon the web, each group comprising a plurality of individual tickets printed in rows and columns.

10. A method as claimed in claim 9, wherein the groups are printed in two bands extending alongside one another on each web, the web thereafter being cut lengthwise to form two narrower webs which are arranged to follow one another end-to-end.

11. A method as claimed in claim 9, wherein the printing of each group is so accomplished that the printed tickets thereof are separable into strips of several tickets, each strip for Tombola having all the numbers 1 to 90 appearing and for Bingo each strip having all the numbers 1 to 75 appearing.

12. A method as claimed in claim 9, wherein the superposition of the identically group-printed coded webs in such that the first coded web, having groups 1, 2, 3 . . . , is in step-shifted registry with the identical groups 1, 2, 3 of the second coded web, the step-shifting bringing the group 1 of the first web into registry with group 2 of the second web, group 2 of the second web being in step-shifted registry with group 3 of the third coded web, and so on.

13. A method according to claim 7, wherein the different game number combinations to appear in repeat sets of booklets are identically printed on one side only of each of a plurality of differently-coded webs, whereby each number combination printed corresponds to a ticket in a booklet, and the method further includes the step of printing on the obverses of the webs an identifying number in registry with every ticket number combination printed thereon, the identifying numbers for all the webs being changed after each successive complete pass of the belt, and each web printed during a single pass of the belt having a unique identifying number different from that of the other webs printed simultaneously therewith, the said number appearing on all the ticket number combinations of that web.

14. A method according to claim 13, wherein the identifying numbers are printed by numbering units, individual to each web, located adjacent each web-printing station, and the method involves advancing the numbers printed thereby after each pass of the belt by an amount equal to the number of webs being simultaneously printed.

15. A method as claimed in claim 1, further including the simultaneous printing and assembling of tickets bearing number combinations into articles known as bingo books.

16. A method according to claim 1, wherein the different number game combinations to appear in a single set of booklets are identically printed on one side only of each of a plurality of differently-coded webs, whereby each number game combination printed corresponds to a ticket in a booklet, and the method further includes the step of printing on the obverses of the webs an identifying number in registry with every ticket number combination printed thereon, each web having a unique identifying number different from that of the other webs and the said number appearing on all the ticket number combinations of the web.

17. A method of producing a set of ticket booklets wherein each booklet has a series of coded tickets arranged in a predetermined sequential fashion which is the same for every booklet in the set but wherein any one ticket in any one booklet bears a coding which is different from every other ticket in the entire set comprising the steps of: producing a predetermined number of identically printed webs, each web being printed with a plurality of individually distinguishable coded indicia, each conforming to a coded ticket; superposing said plurality of identical webs one above the other and longitudinally displacing the identical indicia on adjacent webs with respect to each other whereby any selected identical indicia of any two superposed webs are out of superposed registry with one another; and uniting the webs together followed by severing the united webs in predetermined fashion into the desired set of ticket booklets.

* * * * *